US010100539B2

(12) United States Patent
Baena et al.

(10) Patent No.: US 10,100,539 B2
(45) Date of Patent: Oct. 16, 2018

(54) CONCRETE DEPRESSION FORM SYSTEM AND METHOD

(71) Applicants: Miguel E. Baena, Miami, FL (US); Peter Rodriguez, Atlantic Beach, FL (US); Jason Rodriguez, Atlantic Beach, FL (US); Dennis A. Dohogne, St. Johns, FL (US)

(72) Inventors: Miguel E. Baena, Miami, FL (US); Peter Rodriguez, Atlantic Beach, FL (US); Jason Rodriguez, Atlantic Beach, FL (US); Dennis A. Dohogne, St. Johns, FL (US)

( * ) Notice: Subject to any disclaimer, the term of this patent is extended or adjusted under 35 U.S.C. 154(b) by 228 days.

(21) Appl. No.: 14/975,032

(22) Filed: Dec. 18, 2015

(65) Prior Publication Data

US 2016/0177585 A1 Jun. 23, 2016

Related U.S. Application Data

(60) Provisional application No. 62/093,765, filed on Dec. 18, 2014.

(51) Int. Cl.

| | |
|---|---|
| ***E04G 13/06*** | (2006.01) |
| *E04C 5/18* | (2006.01) |
| *E04C 5/20* | (2006.01) |

(52) U.S. Cl.

CPC ..... *E04G 13/066* (2013.01); *E04C 5/18* (2013.01); *E04C 5/205* (2013.01)

(58) Field of Classification Search

CPC ..... E04G 13/06; E04G 13/062; E04G 13/066; E04G 2001/302; E04G 2001/305; E04G 2001/307; E04G 1/00; E04G 1/02; E04G 1/04; E04G 1/06; E04G 1/08; E04G 1/30; E04G 1/36; E04G 17/00; E04G 11/062; E04G 11/08; E04G 11/20; E04G 11/22; E04G 11/28; E04G 17/002; E06C 7/14; E06C 7/143; E06C 7/146; E06C 7/16; B28B 7/241; E04C 5/18; E04C 5/205

USPC ..... 264/31, 34; 404/7; 52/97, 174, 254, 52/255, 371, 678, 272

See application file for complete search history.

(56) References Cited

U.S. PATENT DOCUMENTS

| | | | | |
|---|---|---|---|---|
| 2,610,380 | A | 9/1952 | Pollman | |
| 3,385,552 | A | 5/1968 | Von Drasek et al. | |
| 3,797,800 | A * | 3/1974 | Loy | E02D 27/02 249/13 |
| 4,466,222 | A | 8/1984 | Mitchell | |
| 6,874,288 | B1 | 4/2005 | Washa et al. | |
| 7,131,624 | B2 | 11/2006 | Bogrett | |
| 7,832,163 | B2 | 11/2010 | Krzowski | |

OTHER PUBLICATIONS

Merriam-Webster, Definition of Tower. (Year: 2013).*

* cited by examiner

*Primary Examiner* — Jacob T Minskey
*Assistant Examiner* — Sedef E Paquette
(74) *Attorney, Agent, or Firm* — Thomas C. Saitta

(57) ABSTRACT

A concrete depression form system and method having a rail that is readily removable from sacrificial support towers after the concrete has sufficiently cured, leaving a slab having an elevated interior slab surface and a depressed or lower exterior slab surface, the support towers being structured such that concrete flow is only minimally impeded and such that no portion of the support towers extends outwardly from the slab surfaces.

10 Claims, 10 Drawing Sheets

Figure 15
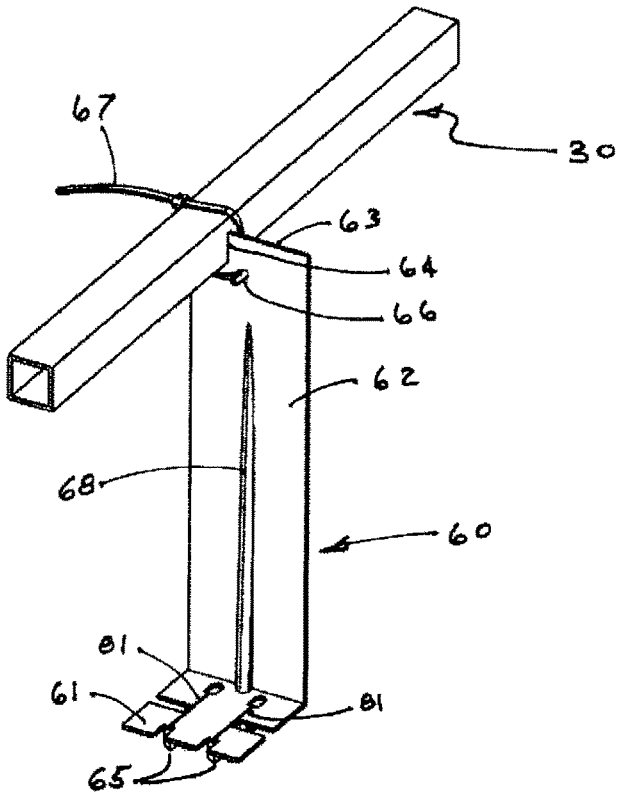
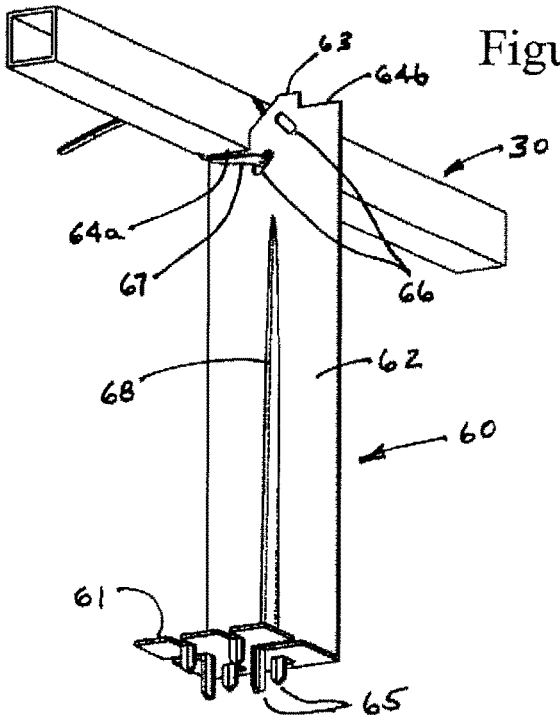
Figure 16

CONCRETE DEPRESSION FORM SYSTEM AND METHOD

This application claims the benefit of U.S. Provisional Patent Application Ser. No. 62/093,765, filed Dec. 18, 2014, the disclosure of which is incorporated herein by reference.

BACKGROUND OF THE INVENTION

This invention relates generally to the field of concrete depression form systems and methods utilized to create a poured concrete slab having a first upper surface and a depressed second upper surface, the second upper surface being lower than the first upper surface.

In the construction of multi-floor apartment buildings, commercial buildings and the like, it is often desired to provide upper floors with peripheral exterior concrete slabs, such as decks or walkways, which are exposed to the elements. To prevent rain water from flowing into the interior of the building, it is customary to construct the exterior portion of the slab with a depressed or lower upper surface relative to the interior floor portion of the slab, such that the vertical wall or shoulder resulting from the difference in height between the interior slab portion upper surface and the exterior slab portion upper surface acts as a water stop or dam.

Both the primary interior concrete slab portion and the depressed exterior concrete slab portion in such a construction may be poured simultaneously by utilizing a horizontally extending, elongated depression rail or scrim that is mounted on individual spaced supports placed upon the bottom form surface, the bottom form often comprising plywood panels which are removed after the concrete cures. The upper edge of the rail is positioned at the desired height for the upper surface of the interior concrete slab portion. The lower edge of the rail is positioned at the desired height for the upper surface of the depressed exterior slab portion, such that the height of the rail determines the height of the water stop wall. When the concrete is poured it first flows under the rail to create the exterior depressed slab portion. The depression rail then impedes additional flow while the pour continues so as to fill in the interior slab portion to the desired height.

The most common technique utilized in this method has not changed in many years. It is typical to use wooden boards, such as 2×4's, as rails mounted upon wooden, plastic or metal supports. This technique is very labor intensive and requires experienced workers to provide a proper set-up prior to the concrete pour. Wooden supports must be removed from the slab prior to complete hardening, with the resulting wells in the slab having to be filled in later. Typical designs for plastic or metal supports usually require post-curing processes, such as cutting or grinding, to remove exposed portions of the supports. It is also known to utilize sacrificial or consumable rails and supports where both remain embedded within the concrete slab, such as shown in U.S. Pat. No. 4,466,222 to Mitchell.

It is an object of this invention to provide a concrete depression form system and method that provides for easier installation than known systems, wherein the rail is readily removable from sacrificial support towers after the concrete has sufficiently cured, leaving a slab having an elevated interior slab surface and a depressed or lower exterior slab surface, the support towers being structured such that concrete flow is only minimally impeded and such that no portion of the support towers extends outward from the slab surfaces, securement of the support towers to the base is readily accomplished, and wherein post-curing processing of the support towers is not required. It is a further object to provide such a system and method possessing other advantages over known systems and methods, as will be apparent from the following disclosure.

SUMMARY OF THE INVENTION

The invention is in general a concrete depression form system and method comprising a removable, horizontally disposed, elongated guide rail or screed member releasably mounted onto a plurality of discrete support towers. The system enables creation of a multi-level slab from a single pour, the upper edge of the rail member determining the surface height of the elevated slab portion relative to the base and the lower edge of the rail member determining the surface height of the depressed or lower slab portion relative to the base. Various cross-sectional configurations may be utilized for the rail member, such as for example a square profile bar, a flat bar, an L-shaped angle iron bar or other bar shapes. The rail member may be straight, angled or curved. Various fasteners may be utilized to releasably mount the rail member to the support towers.

The support towers are preferably formed of folded sheet metal or rigid plastic, but may also be formed of connected wire or rod members. The upper portion of a support tower defines a shoulder to which the rail member is temporarily secured during the slab pouring operation. The support towers may be height-adjustable.

To create the multi-level flooring slab, the support towers are positioned and preferably affixed onto the bottom member, such as a plywood base, of a concrete form assembly. The rail members are mounted and secured to the support towers at the proper height, the rail members being bent or angled as required to produce the proper shape for the finished slab. The concrete is poured on the high side of the support towers so as to flow beneath the rail members, and the slab is then further processed in known manner to create a multi-level slab with a depressed surface and an elevated surface. The slab is then allowed to adequately cure such that flow no longer occurs, at which time the rail members are removed, leaving the support towers embedded in the concrete slab with no protruding exposure above the cured slab on either the high or low side. After full curing the form bottom member beneath the concrete slab is removed.

In alternative language, the invention is described as a method of forming a poured concrete slab comprising an interior elevated slab portion having a first upper surface and an exterior depressed slab portion having a depressed second surface lower than said first upper surface, said method comprising the steps of providing a plurality of sacrificial support towers and positioning said support towers on a bottom form member; providing an elongated rail member, said rail member comprising an upper edge, a lower edge and an interior side, and attaching said rail member to said support towers such that no portion of said support towers extends above said upper edge of said rail member; pouring uncured concrete onto the bottom form member such that a portion of said uncured concrete flows under said lower edge of said rail member and around said support towers to form said depressed slab portion, the depressed second upper surface being even with said lower edge of said rail member; continuing to pour said uncured concrete such that said uncured concrete contacts said interior side of said rail member to form said elevated slab portion such that said first upper surface is even with the upper edge of said rail member; allowing said uncured concrete to cure such that no further flow occurs and wherein said support towers are embedded within the poured concrete slab; and removing said rail member from said support, wherein no portion of said support towers extends above said first upper surface or said depressed second surface of the poured concrete slab. Furthermore, the steps wherein said step of providing said support towers comprises providing support towers that are height adjustable, and further adjusting said support towers to a predetermined height; wherein said step of providing said support towers comprises providing support towers comprising a first notch and a second notch, and wherein said step of positioning said support towers comprises orienting said support towers such that said step of attaching said rail member to said support towers comprises positioning said rail member in either said first notch or said second notch; further comprising the step of providing a positioning line on the bottom form member, and wherein said step of positioning said support towers comprises aligning said support towers in spaced relation along said positioning line such that said interior side of said rail member is aligned with said positioning line; wherein said step of providing said support towers comprises providing support towers comprising alignment members, and wherein said step of positioning said support towers comprises aligning said alignment members along said positioning line such that said interior side of said rail member is aligned with said positioning line; further comprising the step of using said upper edge of said rail member to grade said uncured concrete prior to removal of said rail member; wherein said step of attaching said rail member is performed by securing plastic ties around said rail member; wherein said step of providing support towers comprises providing support towers having integral fixation stakes, and wherein said step of positioning said support towers comprising inserting said fixation stakes into the bottom form member; wherein said step of providing support towers comprises providing support towers formed of rods, each of said support towers comprising a pair of elongated rod members having foot segments, vertical segments, horizontal cross members connecting said pair of elongated rod members, and at least one rail support extension extending beyond one of said elongated rod members and adapted to receive said rail member; and/or wherein said step of providing support towers comprises providing support towers each comprising a thin in cross-section base, a thin in cross-section body, a top edge and at least one notch adapted to receive said rail member.

Alternatively still, the invention is described as a concrete depression form system comprising in combination a plurality of support towers adapted to receive a rail member removably positioned thereon, said rail member having an upper edge and an interior side, such that no portion of said support towers extends above said upper edge of said rail member when said rail member is positioned on said support towers; and rail securement members attaching said rail member to said support towers; whereby said rail member is removable from said support towers after concrete has been poured to form a concrete slab comprising an interior elevated slab portion and an exterior depressed slab portion. Furthermore, wherein said support towers comprise visual alignment members adapted to be aligned with a positioning line placed on a bottom form member prior to pouring said concrete such that said interior side of said rail member is properly positioned; wherein said support towers further comprise integral fixation spikes for affixing said support towers to a bottom form member; wherein said support towers are formed of rods, each of said support towers comprising a pair of elongated rod members having foot segments, vertical segments, horizontal cross members connecting said pair of elongated rod members, and at least one rail support extension extending beyond one of said elongated rod members and adapted to receive said rail member; wherein said support towers comprise two rail support extensions adapted to receive said rail member; wherein said foot segments comprise visual alignment members adapted to be aligned with a positioning line placed on a bottom form member prior to pouring said concrete such that said interior side of said rail member is properly positioned; wherein said support towers each comprise a thin in cross-section base, a thin in cross-section body, a top edge and at least one notch adapted to receive said rail member; wherein said support towers each comprise two notches adapted to receive said rail member; wherein said base comprises visual alignment members adapted to be aligned with a positioning line placed on a bottom form member prior to pouring said concrete such that said interior side of said rail member is properly positioned; and/or further comprising a thin in cross-section extension plate connected to each said support tower, said extension plate comprising at least one notch adapted to receive said rail member such that the height of said rail member is adjustable.

BRIEF DESCRIPTION OF THE DRAWINGS

FIG. 15 illustrates an alternative embodiment of a support tower, the support tower being a plate support tower.

FIG. 16 illustrates an alternative embodiment of a plate support tower, the plate support tower structured to receive a rail member at two different heights.

DETAILED DESCRIPTION OF THE INVENTION

Figure 1:
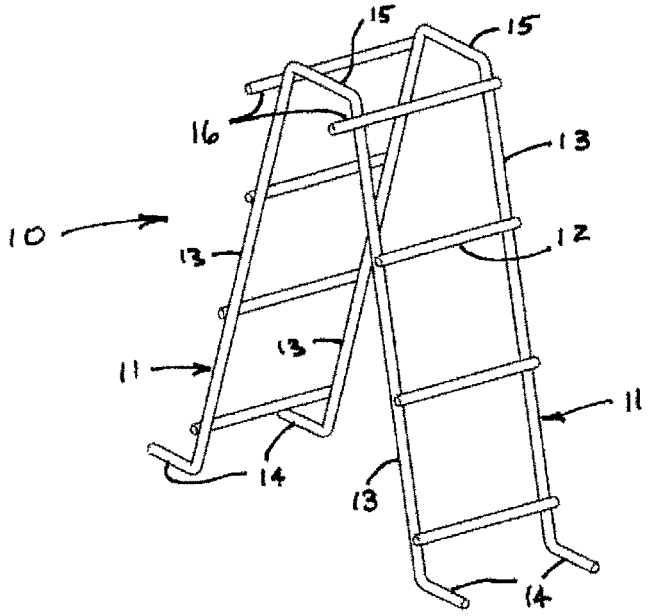
FIG. 1 is a perspective view of an embodiment of a support tower, the support tower being a wire frame support tower.
Figure 2:
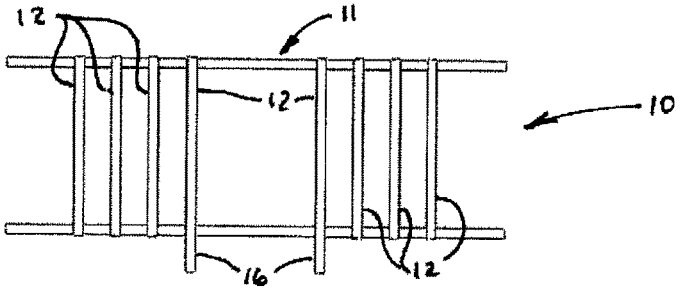
FIGS. 2 through 4 are alternative views of the wire frame support tower of FIG. 1.
Figure 3:
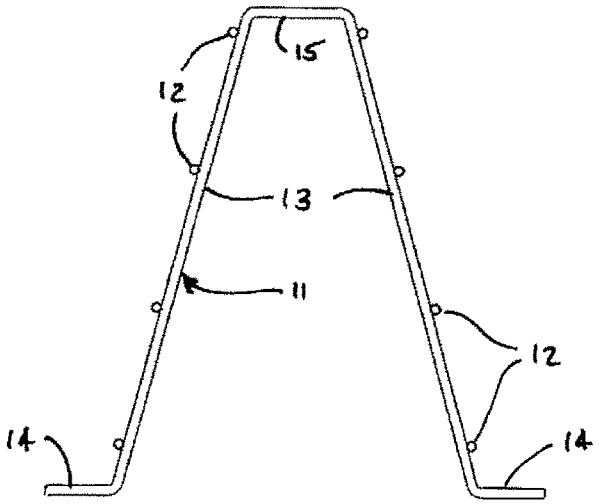
Figure 4:
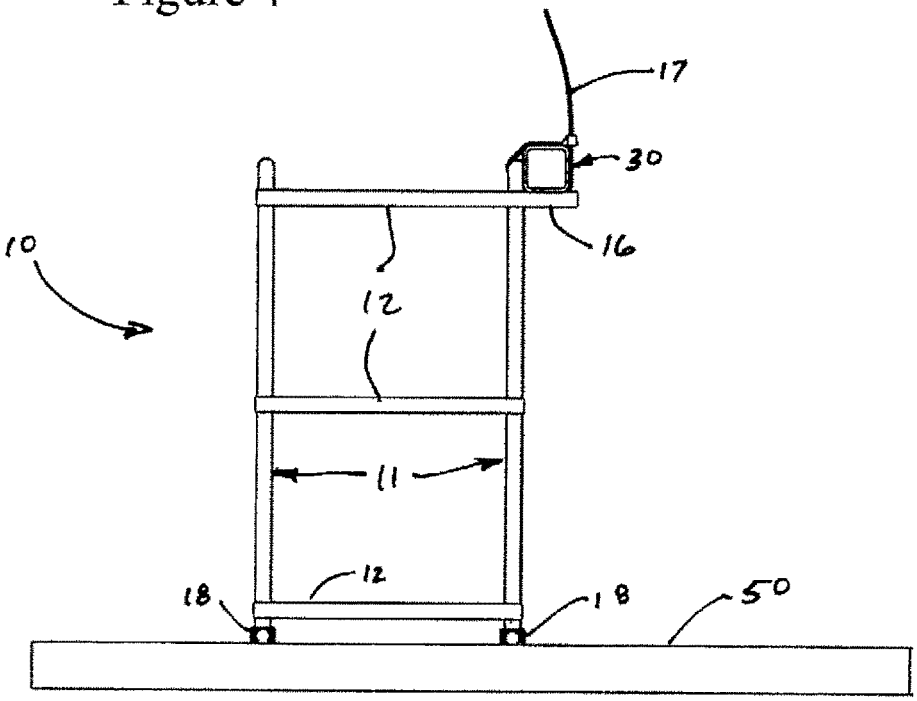

With reference to the drawings, the invention in various embodiments will be described in detail with regard to the best mode and preferred embodiments. In a broad sense, the invention is a concrete depression form system and the method of using such system to create a poured, multi-level, unitary, concrete slab having an elevated or upper surface and a depressed or lower surface, the junction between the elevated surface and the depressed surface defining a water stop wall to prevent intrusion of water onto the elevated surface. Typically, the depressed surface is an exterior surface exposed to the elements, such as a deck or walkway, separated from an interior elevated surface, such as a floor. In general, the system comprises a plurality of discrete support towers which releasably or removably retain an elongated, horizontally disposed, guide rail or screed member having an upper edge and a lower edge. Multiple rail members will be utilized in end-to-end manner when needed. With the support towers and rail members properly positioned and secured onto the bottom form member, concrete is poured on the interior side of the rail member, which then flows beneath the rail member to create the depressed portion of the slab. The height of the lower edge of the rail member above the bottom form member determines the height of the depressed portion. As the concrete pour continues, the rail member impedes flow of the concrete such that the concrete on the interior side of the rail member rises to create the elevated portion of the slab. The upper edge of the rail member is used as a screed guide for finishing the concrete surface in known manner. Upon curing, the rail members are removed.

As used herein, the terms "external", "exterior" or the like shall refer to the side or direction from the elevated slab portion toward the depressed slab portion, i.e., toward the exterior of the building, while the terms "internal", "interior" or the like shall refer to the side or direction from the depressed slab portion toward the elevated slab portion, i.e., toward the interior of the building. The term "horizontal" or the like shall refer to the plane or direction that is coplanar to the top of the slab or the bottom form member, while the term "vertical" or the like shall refer to the upward direction generally but not necessarily perpendicular to the horizontal direction.

The embodiments described and shown in the drawings are meant to be illustrative of the invention and are not meant to be limiting.

Figure 5:
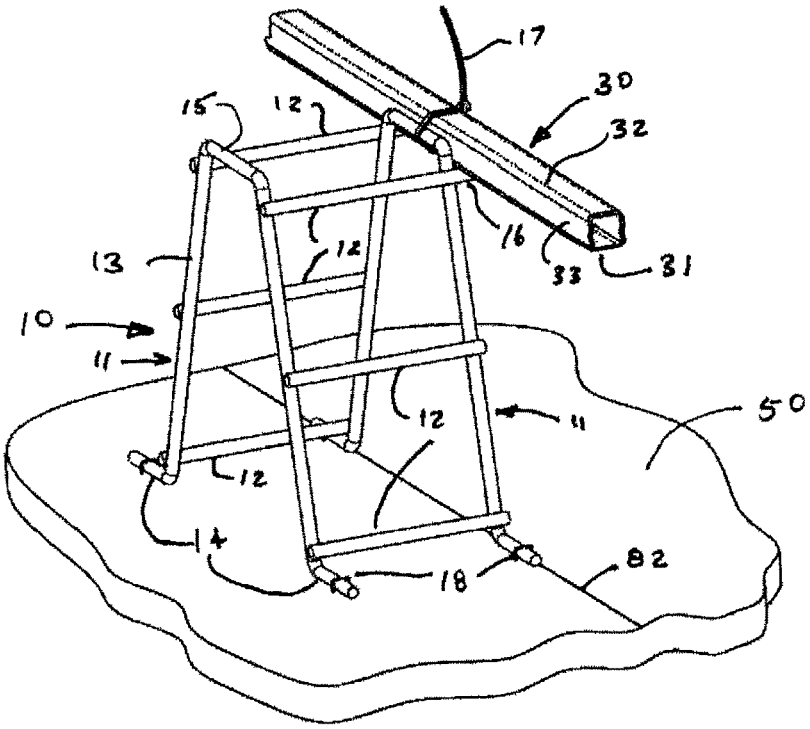
FIG. 5 is an illustration of a rail member secured to the wire frame support tower of FIG. 1 prior to the pouring of the concrete.
Figure 6:
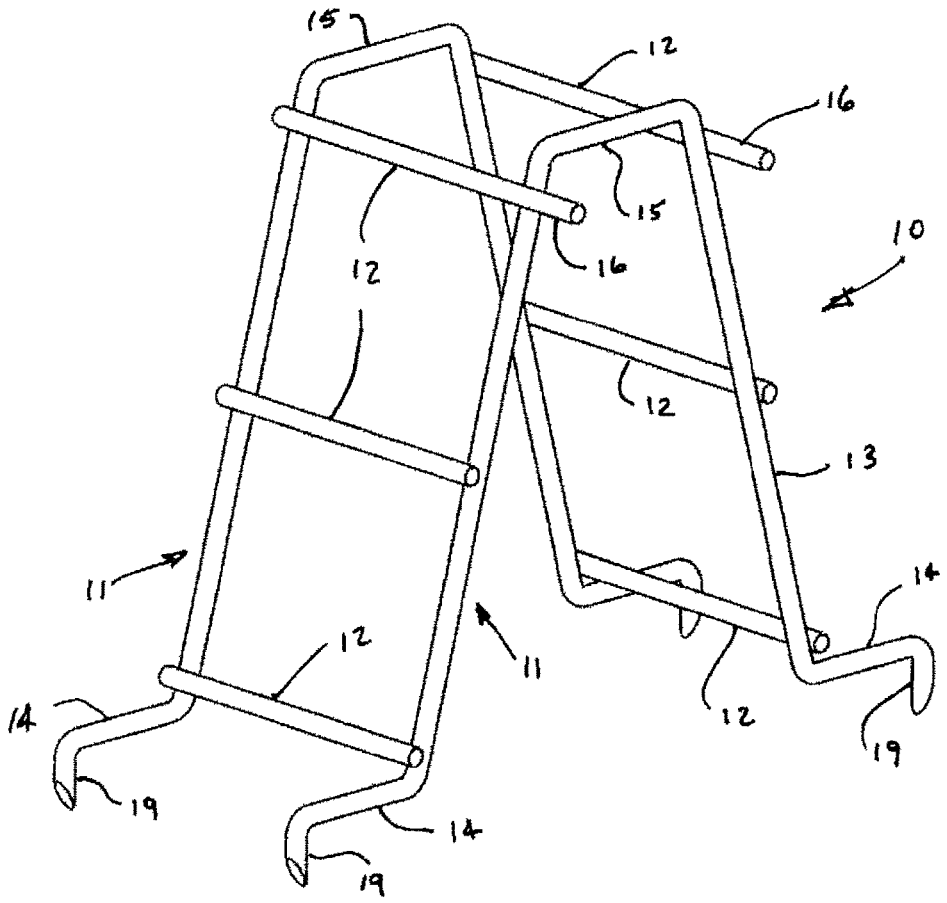
FIG. 6 is a perspective view of an alternative embodiment of a wire frame support tower, showing a tower with fixation spikes.
Figure 7:
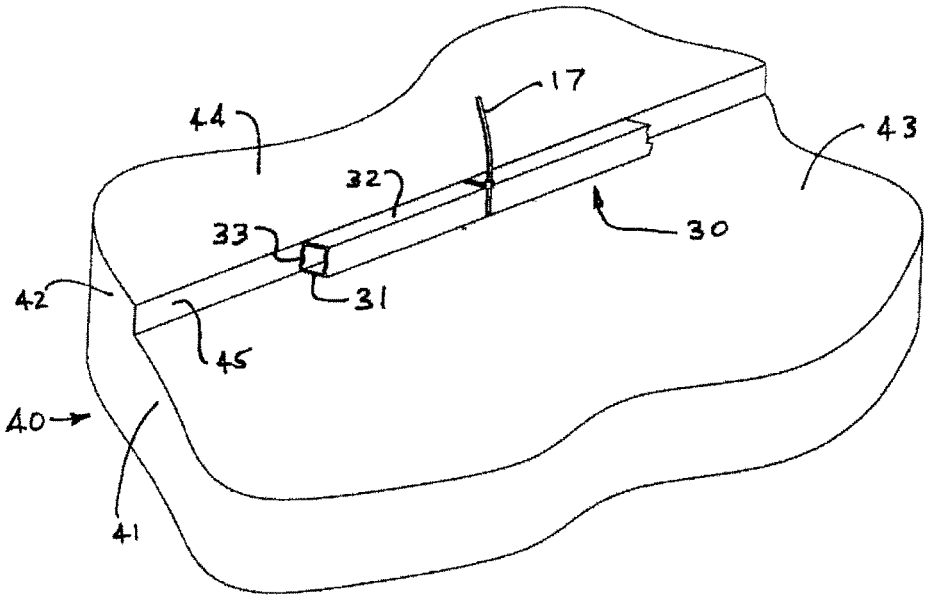
FIG. 7 is an illustration showing an exposed rail member and embedded support tower after the concrete has been poured.
Figure 8:
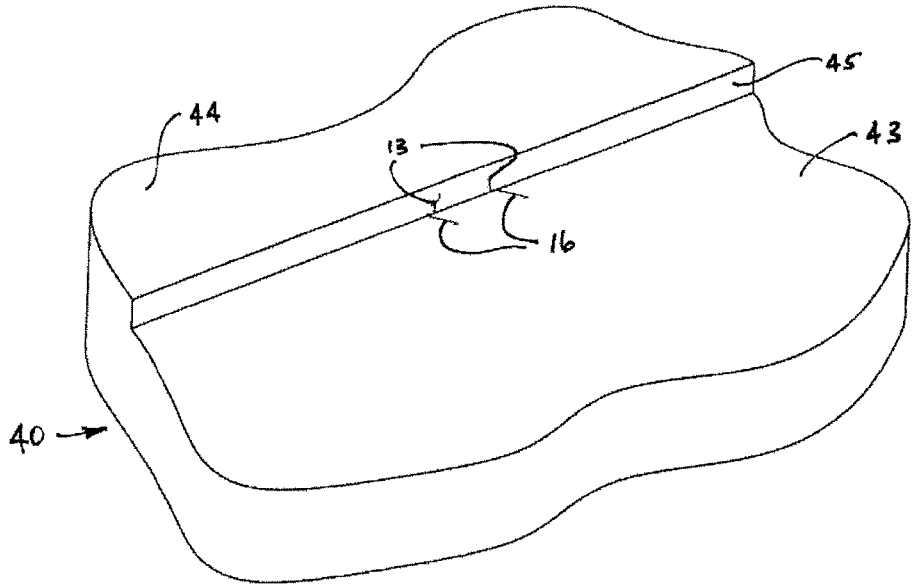
FIG. 8 is an illustration similar to FIG. 7 in which the rail member has been detached from the support tower and removed.

FIGS. 1 through 4 illustrate a first embodiment for the support tower 10, which in this embodiment comprises a wire frame support tower 10 composed of stiff wire or rod members, preferably composed of metal. The wire frame support tower 10 comprises a pair of elongated rod members 11 rigidly joined together by a plurality of horizontal cross members 12, the cross members 12 being welded, bonded or otherwise affixed to the elongated rod members 11. The elongated rod members 11 are preferably identical and fixed in parallel orientation. The upper ends of each elongated rod member 11 comprises a generally horizontal upper segment 15 extending between and connecting the upper ends of the vertical segments 13. Each elongated rod member 11 preferably comprises a pair of vertical segments 13, preferably angled such that the distance between the lower ends of the vertical segments 13 is greater than the distance between the upper ends of the vertical segments 13. Foot segments 14 to support the wire frame support tower 10 in a stable and upright orientation extend horizontally from the lower ends of the vertical segments 13. Tower securement members 18, such as mechanical fasteners, may be provided to affix the wire frame support towers 10 to the wooden bottom form member 50, as shown in FIG. 5. The ends of the foot segments 14 may be bent down and sharpened to form integral fixation barbs or spikes 19, as shown in FIG. 6, such that separate tower securement members 18 are not required, such that the tower 10 may be affixed by driving the spikes 19 directly into the wooden bottom form member 50.

At least one, but preferably a pair of rail support extension 16 extend outwardly to the exterior of one of the elongated rod members 11, the rail support members 16 preferably being formed by a pair of uppermost cross members 12 that have a greater length than the distance separating the two elongated rod members 11. The rail support extensions 16 are disposed on the vertical segments 13 a short distance below the horizontal upper segment 15 of one of the rail support members 11, such that the combination of the rail support extensions 16, the portions of the vertical segments 13 extending above the rail support extensions 16 and the horizontal upper segment 15 creates a receiving shoulder to retain a rail member 30, which preferably comprises a tubular, square profile, i.e., one having a square cross-sectional profile. Other configurations for rail member 30 may also be utilized, such as but not limited to a flat bar or L-shaped angle iron. The rail support extensions 16 extend a sufficient distance underneath the rail member 30 to maintain the rail member 30 on the receiving shoulder, which may be less or more than the width of the rail member 30. The rail member 30 is preferably affixed to the wire frame support tower 10 by rail securement members 17, such as wire members, plastic ties or the like. Rail securement members 17 are chosen such that they are easily cut or removed after the slab 40 has sufficiently cured to allow for removal of the rail member 30 from the wire frame support tower 10.

Figure 11:
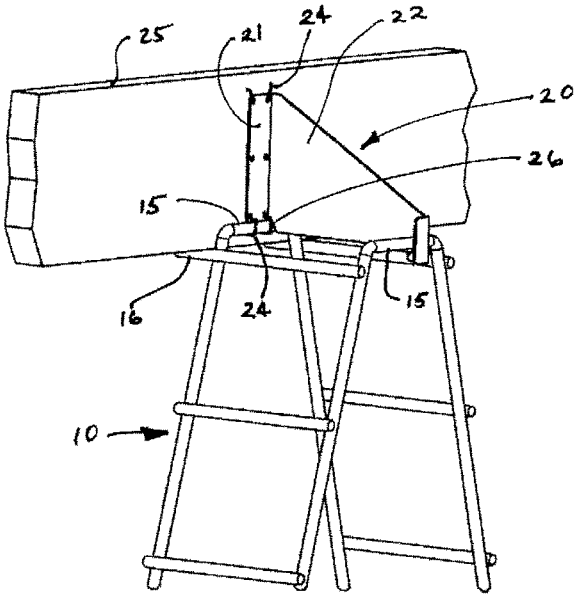
FIGS. 11 through 13 show alternative views of an extension bracket and screed board mounted to a wire frame support tower.
Figure 12:
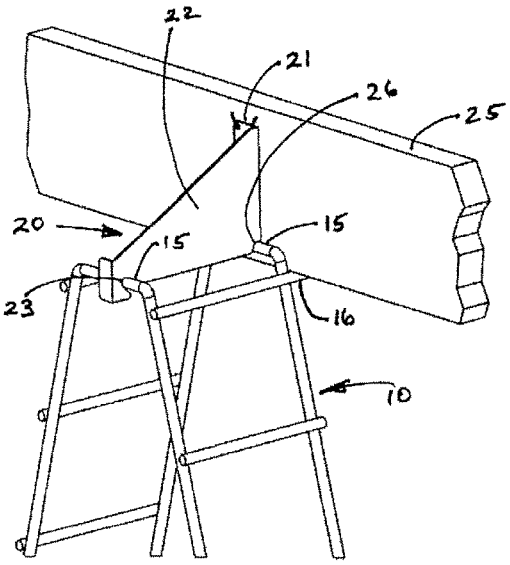
Figure 13:
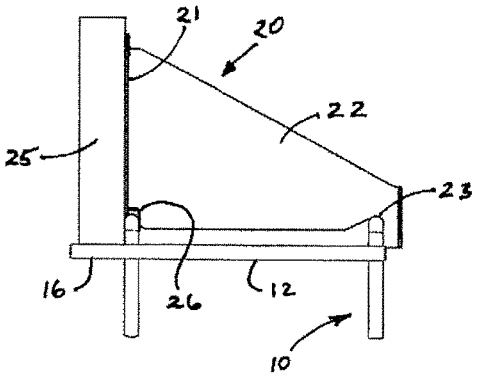

For larger depressions, i.e., where a significantly taller water stop wall 45 is desired, a sacrificial or consumable extension bracket member 20 is utilized, as shown in FIGS. 11 through 13. Rail bracket member 20 comprises a mounting flange 21 positioned on a main body 22 so as to abut the rail member 30, an external notch 26 to rest on the upper segment 15 of the exterior elongated rod member 11 and a retention notch or slot 23 to receive the upper segment 15 of the interior elongated rod member 11. The equivalent to rail member 30, in this embodiment typically a wooden board 25, is affixed to the exterior flange 21 in a removable manner, such as with staples or other mechanical fasteners 24, such that the board 25 can be easily removed from the extension bracket member 20 after the concrete has sufficiently cured. The retention slot 23 is structured to secure the rail member 30 on the support tower 10 against movement in the exterior direction when the concrete is being poured.

Figure 14:
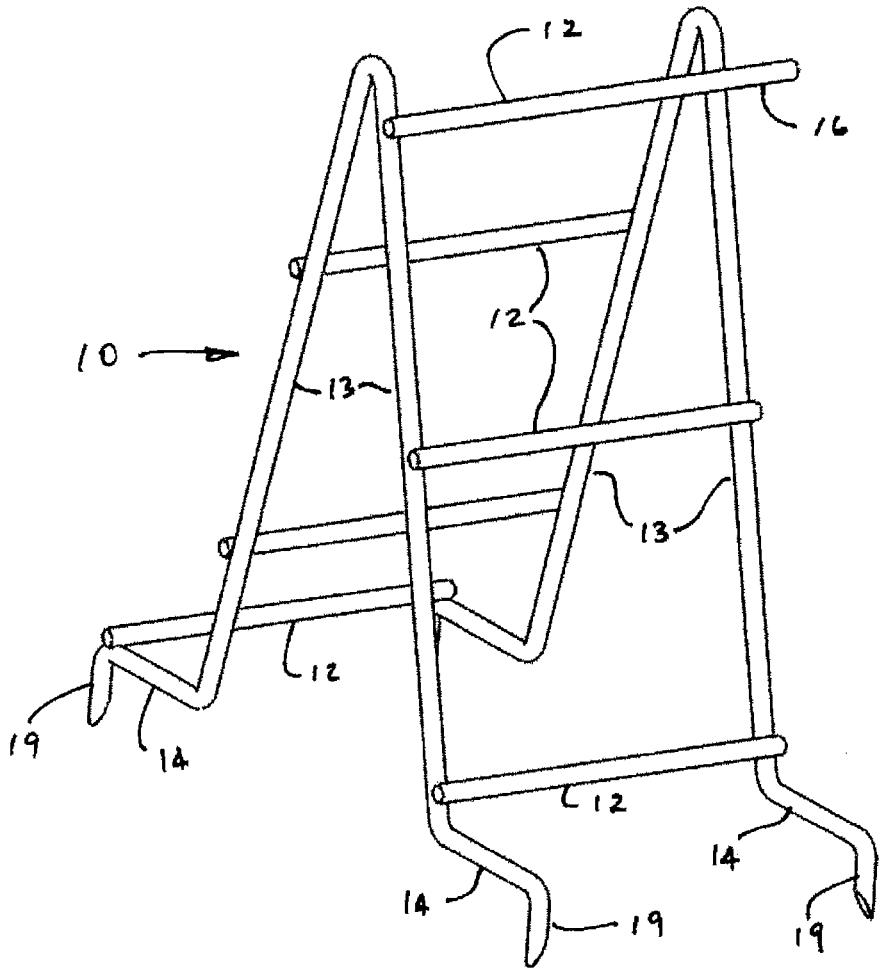
FIG. 14 is an illustration of an alternative embodiment of a wire frame support tower, the support tower being an A-frame support tower.

FIG. 14 illustrates an alternative embodiment for a wire frame support tower 10 wherein the elongated rod members 13 have a single angle at the top, such that the frame is an A-frame style, there being no horizontal segments 15 as shown in the embodiment of FIGS. 1 through 4. In this embodiment there may be only a single uppermost horizontal cross member 12 and thus a single rail support extension 16.

Figure 9:
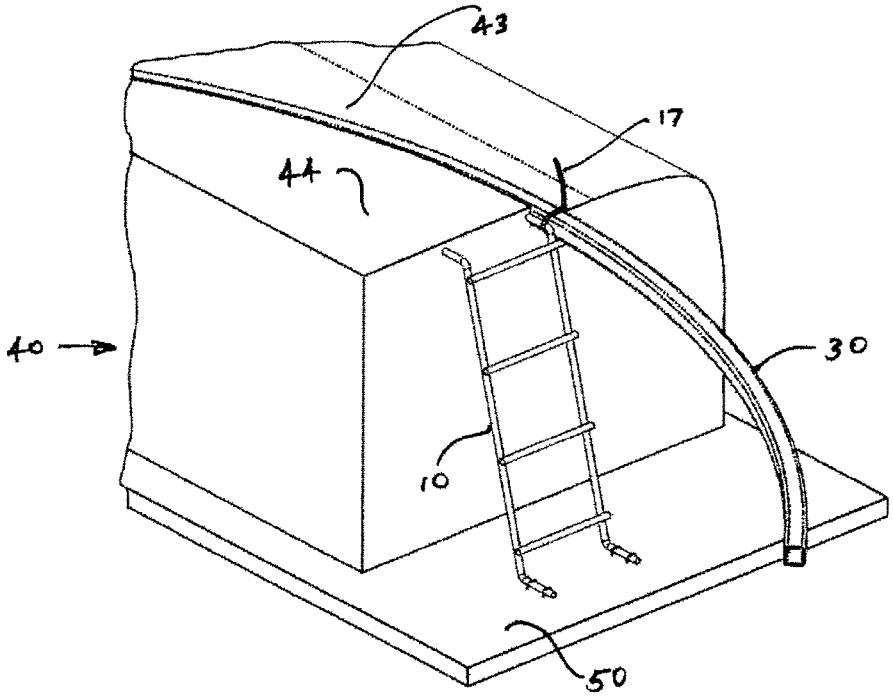
FIG. 9 is an exposed view of a wire frame support tower as embedded in the concrete and a curved rail member.
Figure 10:
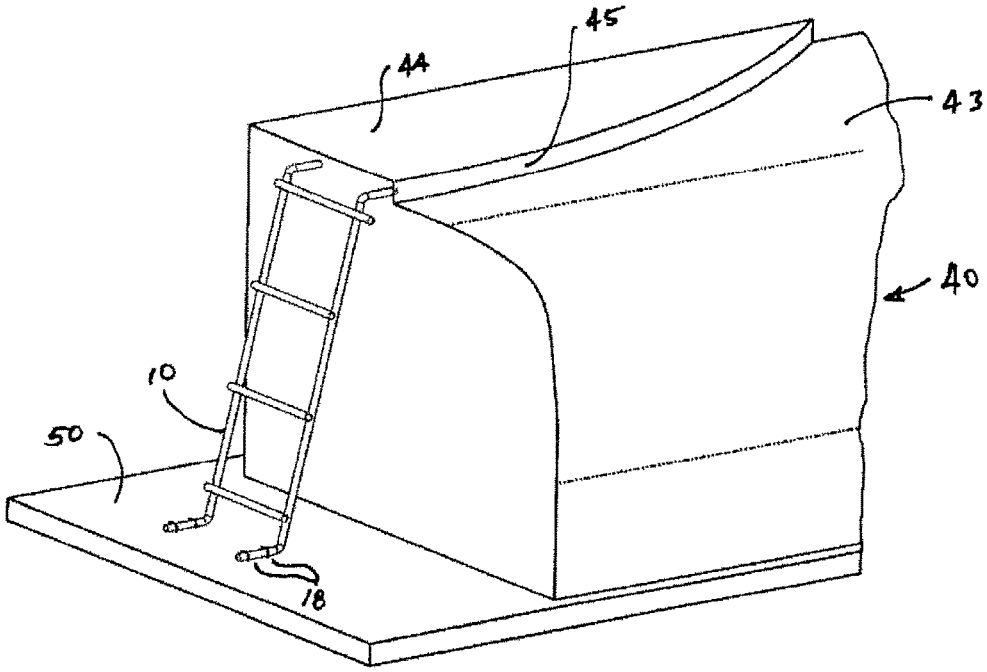
FIG. 10 is an exposed view similar to FIG. 9 in which the curved rail member has been detached from the support tower and removed.

In typical practice the support towers 10 are properly aligned and positioned using a positioning line 82, such as a chalk line, that is applied to the upper surface of the bottom form member 50, the chalk line 82 being applied to the bottom form member 50 where the water stop wall 45 is to be formed. As seen in FIGS. 5, 9 and 10, the support tower 10 is most preferably designed such that the foot segments 14 of the vertical segment 13 located on the same side of the tower 10 as the rail support extensions 16 are aligned with the shoulder formed by the upper portion of the vertical segment 13 and the rail support extensions 16, and therefore also with the interior side 33 of the rail member 30. With the foot segments 14 acting as visual alignment members this insures that the water stop wall 45 connecting the elevated slab upper surface 44 and the depressed slab upper surface 43 is properly located after the concrete is poured.

FIGS. 15 through 20 show various embodiments of a support tower 60, the support tower 60 being a plate support tower 60 formed from a bent plate or sheet of metal or plastic. FIG. 15 illustrates a basic version of the plate support tower 60 comprising a generally horizontal base member 61, thin in cross-section, joined to a generally vertical upright main body 62, also thin in cross-section. The main body 62 comprises a right-angle notch member 64 cut out of the exterior side of the top edge 63, the depth of the notch 64 and the height of the rail member 30 being chosen such that the top edge 63 is even with or below the top of the rail member 30 when the rail member 30 is fastened to the plate support tower 60, such as by passing rail securement members 67 through rail securement apertures 66 positioned in the upper end of the main body 62. The main body 62 of plate support tower 60 may be provided with reinforcing ridges 68. The base member 61 is preferably provided with depending stake members 65 to secure the plate support tower 60 to the bottom form member 50, although alternatively mechanical fasteners could be utilized. The plate support tower 60 is affixed to the bottom form member 50 such that the main body 62 is aligned with its small dimension facing the direction of concrete flow, i.e., with it edges aligned in the internal to external direction rather than its wide sides, such that the support towers 60 do not significantly impede the flow of wet concrete when the slab 40 is poured into the interior and flows from the interior to the exterior.

Figure 17:
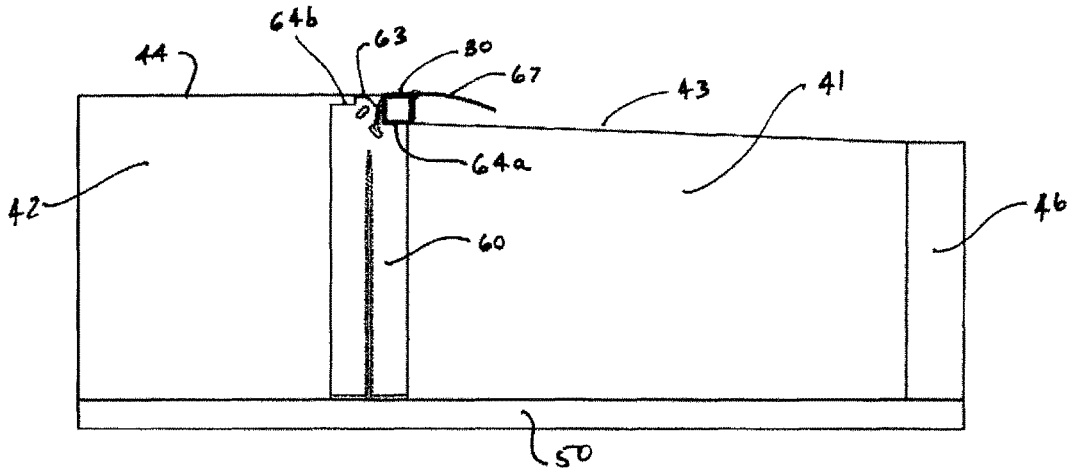
FIG. 17 is an exposed view of a plate support tower as embedded in the concrete with an attached rail member after the concrete has been poured.
Figure 18:
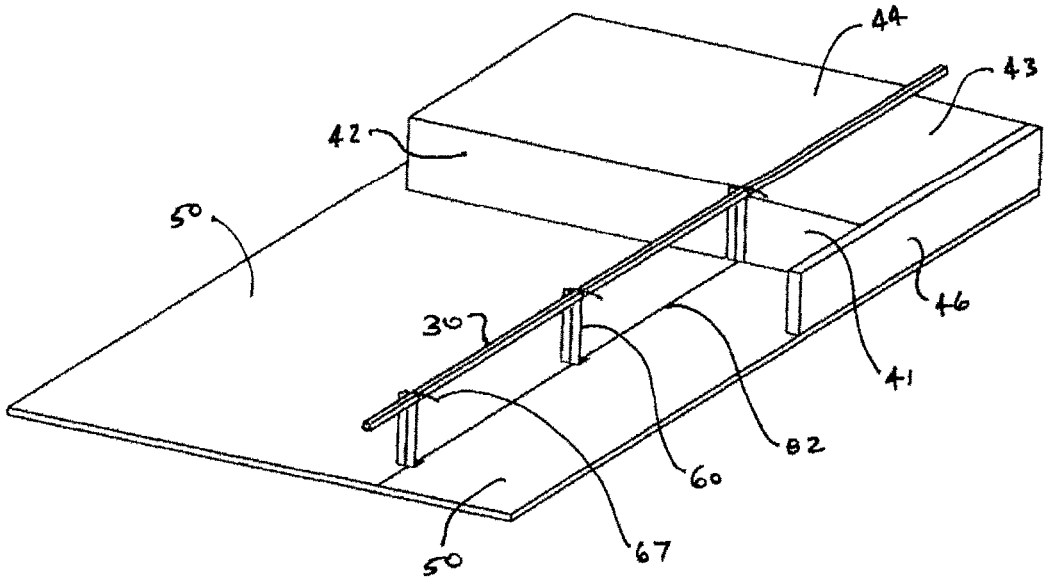
FIG. 18 is an exposed view similar to FIG. 17 showing a plurality of plate support towers, two of which are shown with the concrete slab removed for clarity.

An alternative embodiment for the plate support tower 60 is shown in FIGS. 16 and 17. In this embodiment the upright body member 62 is provided with a first or lower notch member 64*a* on one edge of the upper edge 63 and a second or higher notch member 64*b* on the other edge. With this structure the vertical positioning of the rail member can be raised to create slightly higher slab upper surfaces 43 and 44 or lowered by reversing the orientation of the plate support tower 60 to create slightly lower slab upper surfaces 43 and 44. The outer boundary of the slab 40 is defined by a side form member 46.

In typical practice the plate support towers 60 are properly aligned and positioned using a positioning line 82, such as a chalk line, that is applied to the upper surface of the bottom form member 50, the chalk line 82 being applied to the bottom form member 50 where the water stop wall 45 is to be formed. As seen in FIGS. 15, 16, 19 and 20, the support tower 60 is most preferably designed such that the base member 61 is provided with visual alignment members 81 that are aligned with the shoulder formed by the notch or notches 64 and the top edge 63 of the support tower 60, and therefore with the interior side 33 of the rail member 30. The alignment members 81 may be apertures, cut-out, recesses, protrusions or the like, and may be formed by the openings resulting from punching or cutting the base 61 to create the stake members 65. This insures that the water stop wall 45 connecting the elevated slab upper surface 44 and the depressed slab upper surface 43 is properly located after the concrete is poured.

Figure 19:
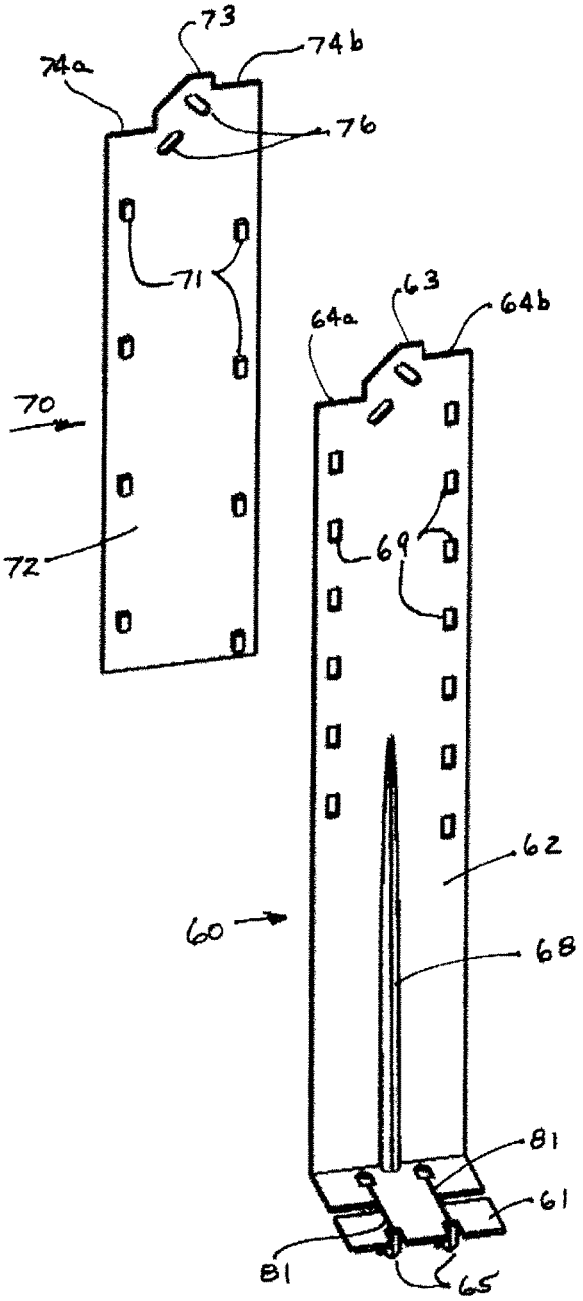
FIG. 19 illustrates the two components of a height-adjustable plate support tower.
Figure 20:
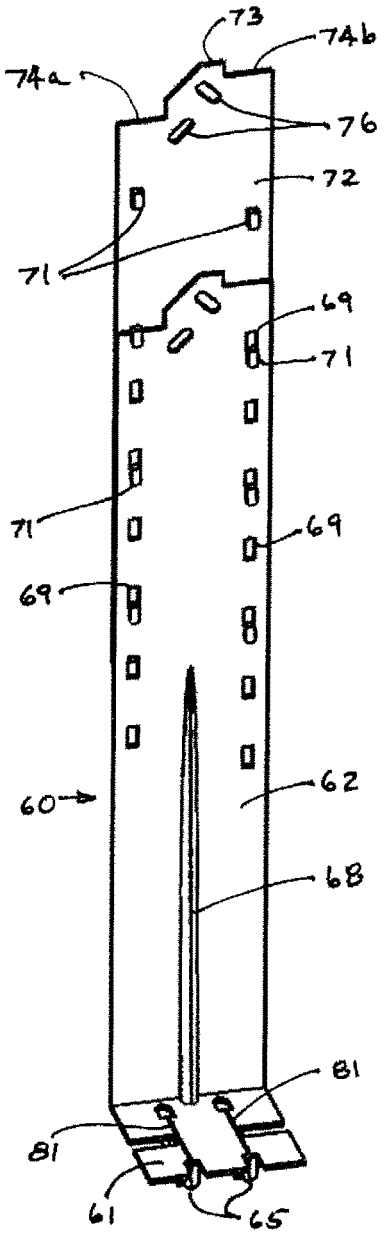
FIG. 20 illustrates the height-adjustable plate support tower of FIG. 19 in the assembled configuration.

Still another embodiment of plate support tower 60 is shown in FIGS. 19 and 20. In this embodiment, the plate support tower further comprises a thin in cross-section extension plate member 70, which is attachable to the main body 62 in a manner such that the extension plate member 70 extends varying distances above the top edge 63 of the plate support tower 60 in order to raise the position of rail member 30. The extension plate member 70 is formed of a sheet or plate of metal or plastic and preferably comprises an extension body 72 having a notched upper edge 73 that possesses either a single notch or a pair of notch members 74*a* and 74*b* that are equivalent to the notch members 64*a* and 64*b* as described above, as well as securement apertures 76. A mechanism is provided to attach or join the extension plate member 70 to the plate tower support 60, such as by providing a plurality of downwardly extending extension tabs 71 along the extension body 72 and providing corresponding extension receiving slots 69 along the main body 62. The extension plate member 70 is attached to the plate tower support member 60 by inserting the extension tabs 71 into the receiving slots 69 to achieve the desired overall height.

A representative example of the method for using the concrete depression form system to form a slab with a depressed external portion on an upper level floor in a building is shown in FIGS. 5, 7-10, 17 and 18, and comprises in known manner preparing and installing a concrete form assembly comprising a bottom form member 50, such as plywood sheet members for example, which are elevated on supports above the lower floor. The proper locations for the water stop walls 45 are determined and the support towers 10 or 60 are positioned and secured to the bottom form member 50 using tower securement members 18, such as staples or similar mechanical fastener, or by driving integral fixation spikes 19 into the bottom form member 50. The support towers 10 or 60 are positioned such that the rail support extensions 16 extend outwardly to the exterior side of the support towers 10 or 60, i.e., toward the depression side of the slab 40.

The rail members 30 are mounted and fastened so as to extend between multiple support towers 10 or 60, the height of the support towers 10 or 60 having been selected so as to properly position the rail member 30 height-wise for the elevated slab upper surface 44 and the depressed slab upper surface 43, which is determined by the upper edges 32 and the lower edges 31 of the rail members 30, respectively. Concrete is then poured into the interior and allowed to flow outward underneath the rail members 30 to fill the main concrete form. When the height of the wet concrete reaches the lower edges 31 of the rail members 30, the concrete flow is impeded by the rail members 30 and the flowing concrete is prevented from continuing onto the depressed slab portion 41. The concrete then builds up on the interior side of the rail members 30 and the flow is stopped when the concrete reaches the upper edges 32 of the rail members 30 and the elevated slab portion 42 is properly filled. The upper edges 32 of the rail members 30 may be used as screed guides to finish the elevated slab upper surface 44. Once the concrete has hardened to the point where gravity flow no longer occurs, the rail members 30 are removed from the support towers 10 or 60 by cutting the rail fasteners 17 or 67 flush with the concrete surfaces, or cutting the rail fasteners 17 and 67 and then pulling them from the concrete prior to full curing. The support towers 10 or 60 are deemed sacrificial or consumable, as they are left embedded in the concrete slab 40. After full curing, the main concrete form members and their supports are removed. Because no portions of the support towers 10 or 60 extend above the depressed slab upper surface 43 or the elevated slab upper surface 44, no subsequent processing of the support tower members 10 or 60 is required.

This method produces a multi-level slab 40 having a depressed slab portion 41 and an elevated slab portion 42 with a vertical water stop wall 45 situated at the junction to prevent water flow from the exterior depressed slab portion 41 to the interior elevated slab portion 42. The height of the water stop wall 45 is determined by the height of the rail members 30. This system and method allow for the formation of a multi-level slab 40 that is more easily and rapidly constructed with less manpower, and results in an accurately dimensioned multi-level slab 40 that requires less post-cure processing.

It is understood that equivalents and substitutions for certain elements and steps set forth above may be obvious to those of skill in the art, and therefore the true scope and definition of the invention is to be as set forth in the following claims.

We claim:

1. A concrete depression form system comprising in combination:

a plurality of sacrificial support towers adapted to receive a rail member removably positioned thereon, said rail member having an upper edge and an interior side, such that no portion of said support towers extends above said upper edge of said rail member when said rail member is positioned on said support towers; and rail securement members attaching said rail member to said support towers;

whereby said rail member is removable from said support towers after concrete has been poured to form a concrete slab comprising an interior elevated slab portion and an exterior depressed slab portion, and whereby said support towers remain embedded within said concrete slab.

2. The system of claim 1, wherein said support towers comprise visual alignment members adapted to be aligned with a positioning line placed on a bottom form member prior to pouring said concrete such that said interior side of said rail member is properly positioned.

3. The system of claim 1, wherein said support towers further comprise integral fixation spikes for affixing said support towers to a bottom form member.

4. The system of claim 1, wherein said support towers are formed of rods, each of said support towers comprising a pair of elongated rod members having foot segments, vertical segments, horizontal cross members connecting said pair of elongated rod members, and at least one rail support extension extending beyond one of said elongated rod members and adapted to receive said rail member.

5. The system of claim 4, wherein said support towers comprise two rail support extensions adapted to receive said rail member.

6. The system of claim 4, wherein said foot segments comprise visual alignment members adapted to be aligned with a positioning line placed on a bottom form member prior to pouring said concrete such that said interior side of said rail member is properly positioned.

7. The system of claim 1, wherein said support towers each comprise a thin in cross-section base, a thin in cross-section body, a top edge and at least one notch adapted to receive said rail member.

8. The system of claim 7, wherein said support towers each comprise two notches adapted to receive said rail member.

9. The system of claim 7, wherein said base comprises visual alignment members adapted to be aligned with a positioning line placed on a bottom form member prior to pouring said concrete such that said interior side of said rail member is properly positioned.

10. The system of claim 7, further comprising a thin in cross-section extension plate connected to each said support tower, said extension plate comprising at least one notch adapted to receive said rail member such that the height of said rail member is adjustable.

* * * * *